US006394826B1

(12) United States Patent
Baxter et al.

(10) Patent No.: US 6,394,826 B1
(45) Date of Patent: May 28, 2002

(54) DUAL ACTUATING SHUTTER SAFETY SYSTEM

(75) Inventors: Charles S. Baxter, Lawrenceville; Willard Francis Amero, Jr., Flowery Branch; Grant H. Lloyd, Lawrenceville, all of GA (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/761,309

(22) Filed: Jan. 17, 2001

(51) Int. Cl.[7] ..... H01R 13/44
(52) U.S. Cl. ..... 439/137; 439/138
(58) Field of Search ..... 439/137, 136, 439/138, 139, 140, 135, 142, 144, 147

(56) References Cited

U.S. PATENT DOCUMENTS 2,155,925 A * 4/1939 Blinn ..... 439/138
2,243,990 A * 6/1941 Thorn et al. ..... 439/120
2,579,538 A * 12/1951 Bierce ..... 439/137
3,352,982 A * 11/1967 Walther ..... 200/51.07
3,990,758 A * 11/1976 Petterson ..... 439/138
5,277,602 A * 1/1994 Yi ..... 439/138

* cited by examiner

*Primary Examiner*—P. Austin Bradley
*Assistant Examiner*—Ross Gushi
(74) *Attorney, Agent, or Firm*—Philip H. Burrus, IV; Bockhop & Reich, LLP

(57) ABSTRACT

A dual actuating shutter safety system for a power supply interface having a housing having a plurality of apertures that provide access to conductive contacts for a first conductive prong and a second conductive prong such that when the prongs contact the conductive contacts, an electrical connection is made therebetween. The system includes a first resilient member and second resilient member that are each rigidly affixed within the housing, and each resilient member has a proximal non-conductive segment that is resiliently held in an aperture and a distal conductive segment that is resiliently held within the housing, whereby the non-conductive segment must be forced aside before the conductive segment of the resilient can be contacted.

3 Claims, 2 Drawing Sheets

DUAL ACTUATING SHUTTER SAFETY SYSTEM

TECHNICAL FIELD

This invention relates generally to mechanical electrical connections, and more particularly to a dual-actuating shutter safety system that protects the interior conductive contacts within a housing.

BACKGROUND

Power supplies use mechanical contacts to make a power connection between a source and a host device. The most common contact is a male plug having a pair of prongs which fit into a female power socket, which typically is rigidly fit within a wall. The male-female power interconnection is common in other power accessories, such as power adapters and chargers.

One major concern of the power interfaces is the live contacts. If a person touches the active power contacts, the person could feel a microshock tingle, and may further damage the host device. To protect the power interconnection, it is common to place a guard or barrier over the apertures of a female socket such that objects are unable to enter the interior of the power socket and touch the electrical contacts. Thus, for the power interconnection to be made, one has to remove the guard or barrier from the female power socket. (This is the common "child outlet protector".) There are also female socket guards, particularly for wall outlets, that allow a simple action to open the apertures of the female such as twisting the guard or placing the male prongs into the guard and the prongs will move the guard and insert into the apertures to ultimately contact the conductive power contacts.

Due to the safety concerns, many governmental organizations, like the Underwriter's Laboratories, "UL", have safety requirements of power interconnections. The safety criteria may include a minimum distance between a live contact and any exterior opening or aperture of the adapter housing. Moreover, safety regulations may also require a covering for the apertures of female power sockets that retards the entry of objects into the housing to contact the conductive contacts. One further common regulation is the limitation of the extent that the prong can extend outside of the housing while in live contact with the conductive contact in the interior of the housing. Other regulations include a minimum cover resistance force.

Accordingly, it would be advantageous to create a shutter safety system that can block the apertures of a female power housing and which will allow objects, such as prongs, to pass and contact the conductive contacts only upon force being exerted on the shutters. Such system should also allow the prongs to be substantially within the housing prior to contacting the conductive contacts, and thereby conducting current, to comply with existing safety regulations. It is thus to the provision of such an improved shutter safety system that the present invention is primarily directed.

DETAILED DESCRIPTION OF THE INVENTION

Figure 1:
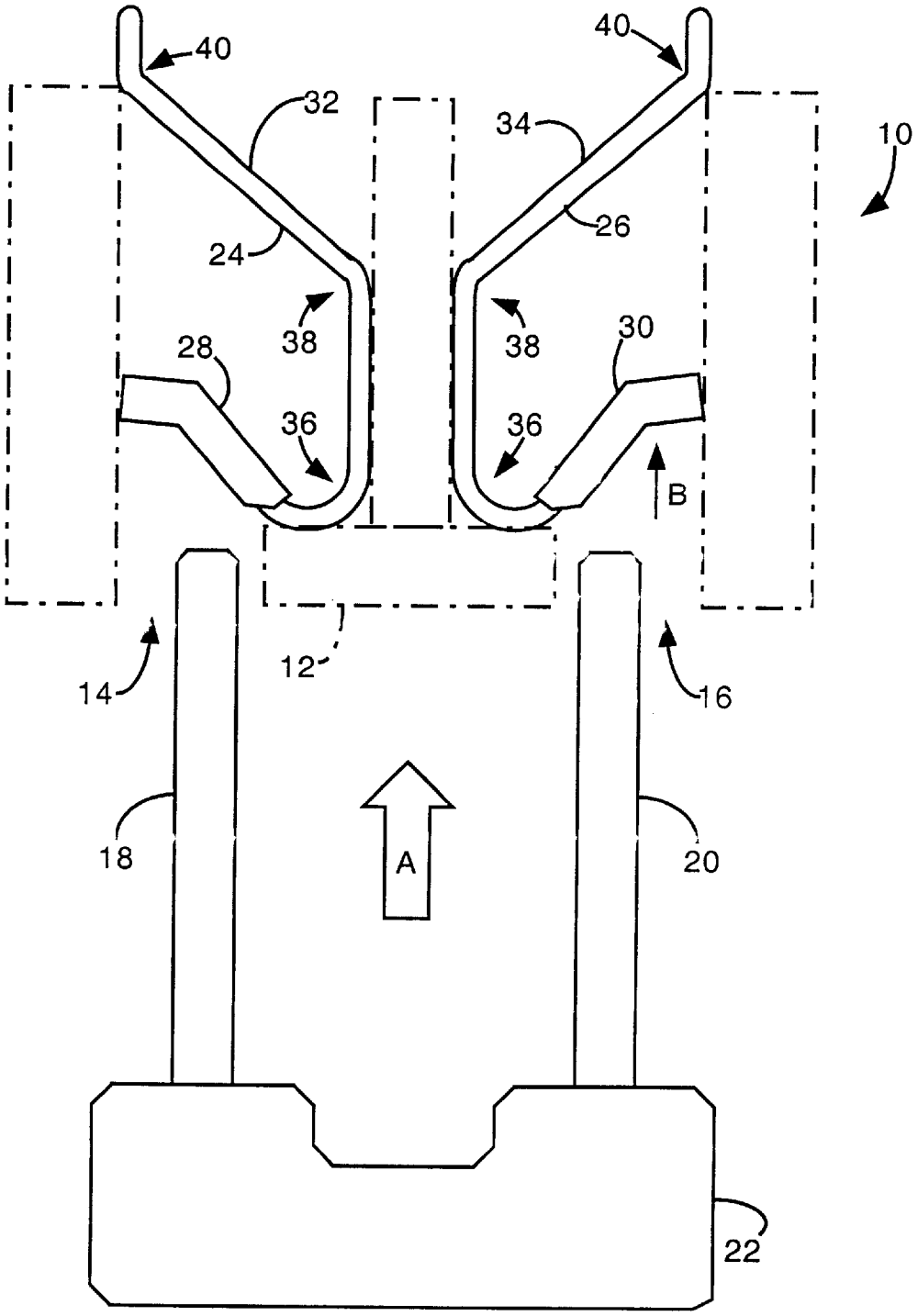
FIG. 1 is a perspective view of a plug in alignment with the apertures and non-conductive segments of the resilient members within the housing.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Referring now to FIG. 1, illustrated therein is a dual actuating shutter safety system 10 in a housing 12 having a plurality of apertures 14 and 16 providing access to conductive contacts for a first conductive prong 18 and a second conductive prong 20. While the prongs 18,20 are shown here as rigidly affixed to a plug 22, the prongs 18,20 can be attached to other known electronic devices that use prongs to make power interconnections. Moreover, the housing 12 here is preferably a power adapter which allows a power interconnection between a power source and a device which is unable to directly draw power from the power source. In such case, the adapter connects to the power source and alters the power in whatever manner is needed for usage by the device, and the device plugs into the adapter to draw the usable power. Here, the specific power components of the housing 12 are well known in the art of power adapters and accessories.

Furthermore, adapters are often used with power cords from other electronic devices, such as camcorders and laptop computers. When prongs are inserted into the adapter that are not designed for the adapter, if there is a backstop to the prongs, the prongs might not fully insert into the housing such that the prongs are exposed while they conduct power. Here, the system 10 does not have a backstop to prevent the full insertion of prongs of a length greater then the prongs for which the housing 12 is designed to fit to prevent a live prong 18,20 extending from the housing 12.

The system 10 provides a simple manner in which to protect the apertures 14,16 from objects entering within the housing 12 through the use of a first resilient member 24 and second resilient member 26 that are each rigidly affixed within the housing 12. Each resilient member 24,26 has a proximal non-conductive segment 28,30 and each of which are resiliently held in aperture 14 and 16 respectively. The resilient members 24,26 further include a distal conductive segment 32,34 and each of which resiliently held within the housing 12. The conductive segments 32,34 are a pair of conductive contacts that will carry a current if touched by a conductive object. The non-conductive segments 28,30 act a shutter mechanism that closes off the apertures 14,16 to block access to the conductive contacts when the device is not in use. The shutter mechanism preferably withstands at least 5N force applied with a 1 mm test probe in the direction of arrow B, which complies with the safety requirements of the regulatory agencies of most countries.

This invention thus incorporates the conductive contacts and shutter mechanism into one system. There are three spring arms in the system 10: the non-conductive segment spring 36, a conductive segment spring 38 and a conductive contact spring 40. The non-conductive segment spring 36 arm acts as the shutter mechanism, and the conductive segment spring 38 and the conductive contact spring 40 effect a resilient contact between the prongs 18,20 and the conductive contact segments 32,34. It is preferred that the non-conductive segments 28,30 are moved from the apertures 14,16, in the direction of arrow B, with at least 5 N of force. As stated above, this level of resiliency complies with many of the safety regulations that regulatory bodies have requiring shutters to have to impede contact with a live conductive contact.

One preferred method of construction of the resilient members 24,26 is to form them from a single piece of resilient conductive metal into a shape having the springs 36,38,40. The non-conductive segments 28,30, plastic is preferably molded over the metal of the non-conductive segment 28,30 to ensure the insulation of the shutter. Thus, the non-conductive segments 28,30 are protective shutters which impede conductive contact with the resilient members 24,26 and entry into the housing 12.

Figure 4:
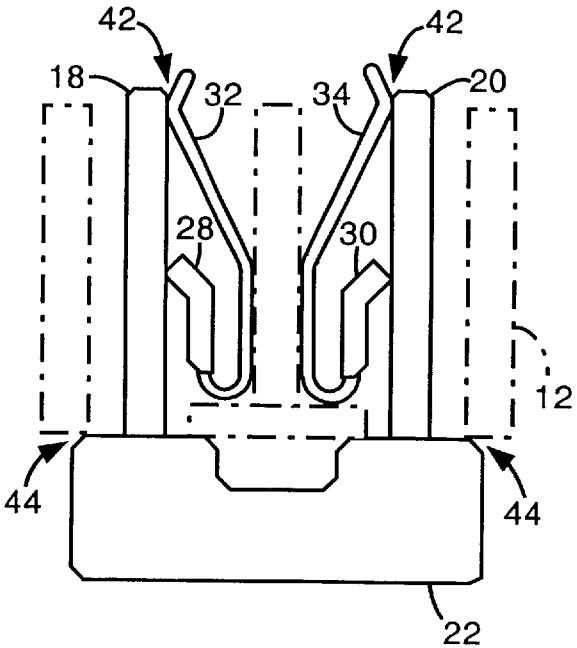
FIG. 4 is a perspective view of the plug fully inserted into the housing, and illustrating the prongs fully bending the non-conductive segments whereby the prongs contact the rear conductive segments of the resilient members.
Figure 3:
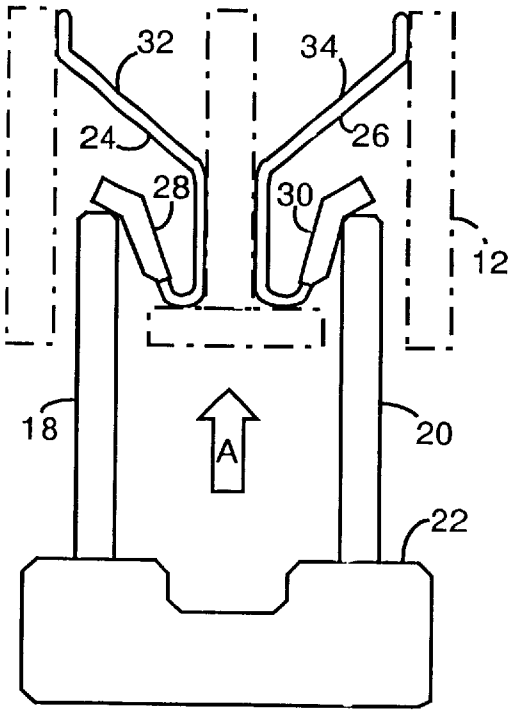
FIG. 3 is a perspective view of the prongs of the plug bending back the non-conductive segments as the prongs of the plug are inserted into the apertures.
Figure 2:
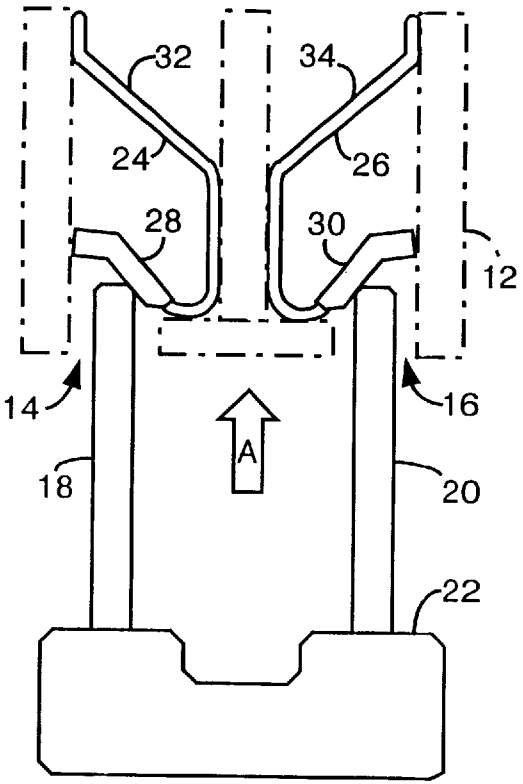
FIG. 2 is a perspective view of the prongs of the plug contacting the non-conductive segments as the plug is inserted into the housing.

As shown in FIGS. 2–4, the resilient members 24,26 provide the safety features desirous in a male-female power socket interconnection, as the plug 22 is moved in the direction of arrow A to fit within the apertures 14,16. To make a power connection between the prongs 18,20 and the housing 10, the first prong 18 and second prong 20 of the plug 22 are selectively forced, in the direction of arrow A, past the proximal non-conductive segments 28,20 of the resilient members 24,26, and the first prong 18 and second prong 20 make conductive contact with the resilient conductive segments 32,34 of the resilient members 24,26.

In FIG. 2, the first prong 18 and second prong 20 are selectively placed to abut the non-conductive segments 28,30 respectively, and such motion aligns the plug 22 to force the prongs 18,20 into the housing and make a power interconnection. Once the force of the prongs 18,20 reaches or exceeds 5N (in the direction of arrow A), the prongs 18,20 will begin to force the non-conductive segments backward, against the opposition of the spring arms 36 of the resilient members 24,26.

In FIG. 3, the prongs 18,20 are forcing back the proximal non-conductive segments 28,30 of the first resilient member 24 and second resilient member 26 whereby the prongs 18,20 enter the housing 10 and can ultimately make contact with the conductive segments 32,34. It can be seen that even as the prongs 18,20 enter the housing 12 through the apertures 14,16, the prongs 18,20 do not contact the conductive segments 32,34 so that the prongs 18,20 are not conducting current while they are exposed from the housing 12. Because the prongs 18,20 only contact the non-conductive segments 28,30 while the prongs 18,20 are being inserted into the housing 12, the prongs 18,20 are insulated from the resilient members 24,26 until actual contact is made between the prongs 18,20 and the conductive segments 32,34.

In FIG. 4, the plug 22 is fully inserted into the housing 12, and the first prong 18 and second prong 20 make conductive contact with the resilient conductive segments 32,34 of the resilient members 24,26, at contact points 42. Once the prongs 18,20 are in contact with the conductive segments 32,34, the plug 22 is flush with the housing 12, at plug-housing interfaces 44 such that there is not greater than 5 mm of clearance between the housing 12 and plug 22. The 5 mm or less clearance between the housing 12 and the plug 22 will comply with most safety regulations regarding the access to electrified parts of devices.

Upon withdrawal of the first prong 18 and second prong 20 from the housing 10 and apertures 14,16, the non-conductive segments 28,30 will again resiliently cover the apertures 14,16. Such action blocks entry to housing 12 through the apertures 14,16 and can prevent the use of the adapter (housing 12) with other power cords of devices, as well as providing a safety barrier to persons attempts to insert objects into the housing 12, such as a child attempting to insert a key or paperclip.

While the preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims.

What is claimed is:

1. A dual actuating shutter safety system providing access to conductive contacts for a plurality of conducting prongs, including at least a first prong and a second prong, the system comprising:

at least a first resilient member and second resilient member, each member rigidly affixed within the housing, and each resilient member including a proximal non-conductive segment that is resiliently held in the aperture and a distal conductive segment that is resiliently held within the housing, the conductive segments comprising a pair of conductive contacts, and wherein the first prong and second prong are selectively forced past the proximal non-conductive segments of the first and second resilient members, and the first prong and second prong make conductive contact with the resilient conductive segments of the resilient members, and upon withdrawal of the first prong and second prong from the housing and apertures, the non-conductive segments again resiliently covering the apertures;

wherein each resilient member is formed from a single piece of conductive metal, and the non-conductive segment is formed from placing plastic over the distal segment of the metal resilient member.

2. The system of claim 1, wherein the first prong and the second prong are rigidly attached to a plug.

3. The system of claim 1, wherein the non-conductive segment is moved from the aperture with at least 5 N of force.

* * * * *